US005979939A

United States Patent [19]

Siboni

[11] Patent Number: 5,979,939

[45] Date of Patent: Nov. 9, 1999

[54] ACCESSORY FOR IN-LINE SKATES

[76] Inventor: Eytan Siboni, 3 Eckhardt Ter., North Arlington, N.J. 07031

[21] Appl. No.: 08/831,679

[22] Filed: Apr. 10, 1997

Related U.S. Application Data

[63] Continuation of application No. 08/582,454, Jan. 3, 1996, abandoned.

[51] Int. Cl.[6] ..... A63C 17/00

[52] U.S. Cl. ..... 280/809; 280/11.22

[58] Field of Search ..... 280/11.12, 11.131, 280/11.19, 11.22, 11.23, 11.26, 11.27, 11.28, 87.041, 87.042, 809

[56] References Cited

U.S. PATENT DOCUMENTS

| | | | |
|---|---|---|---|
| 1,345,038 | 6/1920 | Uppling | 280/11.21 |
| 2,484,494 | 10/1949 | Ferguson | 2/24 |
| 2,546,726 | 3/1951 | Creamer, Jr. | 119/1 |
| 3,484,116 | 12/1969 | Allen | 280/11.21 |
| 3,684,305 | 8/1972 | McDonald et al. | 280/11.19 |
| 4,076,263 | 2/1978 | Rand . | |
| 4,691,453 | 9/1987 | Tifre . | |
| 4,821,676 | 4/1989 | Hulterstrum | 280/63 |
| 5,409,265 | 4/1995 | Douglass . | |
| 5,427,391 | 6/1995 | Cooper . | |

*Primary Examiner*—Richard M. Camby
*Attorney, Agent, or Firm*—Schweitzer Cornman Gross & Bondell LLP

[57] ABSTRACT

A roller skating accessory having means for attaching it to the body of a wearer, and means for rollably supporting the accessory on the ground or other surface when the wearer is in a position contacting the accessory with the ground or other surface.

31 Claims, 12 Drawing Sheets

ACCESSORY FOR IN-LINE SKATES

This is a continuing application of Ser. No. 08/582,454, filed on Jan. 3, 1996 now abandoned.

FIELD OF THE INVENTION

The present invention relates to the next generation of in-line skates, and accessories therefor.

BACKGROUND OF THE INVENTION

Originally in-line roller skates were developed in the early 1700s in the Netherlands with the intention to simulate ice skating in the summer, by nailing wooden spools to strips of wood and attaching them to the shoe. In 1823 in London a skate was developed under the name of "Rolito" by placing five wheels in a row on the bottom of a shoe. In 1863 James Plimpton in America made a workable roller skate by mounting pairs of wheels side-by-side. These allowed turns and forward and backward skating. The addition of ball-bearings to the wheels in 1884 was a further Improvement.

In 1980 an in-line skate was developed by ice hockey players as a cross-training device by combining the skate with a hockey boot, polyurethane wheels, and a rubber heel-brake which skated on land in the same manner as the hockey players skated on ice. This lead to the establishment of Rollerblade, Inc. wherein the name of the company became for years a the popular term for what are today generically referred to as in-line skates.

In-line skates having five wheels, in which the front wheel extends forward of the boot on the skate, permit a greater flexibility in skating with a foot lifted up "on the toes". Shorter wheelbase skates with four wheels are also available. The 4-wheel in-line skates are somewhat slower than the five-wheel skates, but they are easier to master.

The in-line skating accessories of the present invention represent a next generation of in-line skating, because they permit a broader variety of extreme skating with a largely increased capability of various acrobatic movements and greater speed and maneuverability. They provide increased capability of bashing, crossover, backward movements or tricks, stair riding, alley-oops, soul grinds, backside grinds, camels, cess slides, stalls, cross grabs, curb grinds, path slides, fast souls, flips, airs, verts, miszous, slaloming, runouts, swizzles, spins, loops, and various other in-line and extreme in-line skating moves.

In-line skates have a tendency of uneven wheel wear, requiring the replacement or rearrangement of the wheels. Furthermore, all forms of in-line skating essentially requires a maintenance of a substantially upright position except as may be required for shifting the body weight forward, backward or sideways for maintaining proper balance during any acrobatic moves. Braking is accomplished by tilting the foot forward or rearward, depending on the location of a break pad, or sometimes turning the in-line skates sideways, at 90° to the running direction.

SUMMARY OF THE INVENTION

It is an object of the present invention to provide a novel in-line skating accessory which vastly enlarges the heretofore available limited variety of extreme skating and acrobatic and other moves.

It is another object of the present invention to increase the safety of in-line skating by providing for the continued and safe rolling of a skater in the case of a fall, by having or placing a wheel at the expected body location that impacts with the ground, to continue the rolling.

As used throughout the specification and the claims, reference to a "wheel" includes any skating contrivance adapted to move by rolling motion on the ground. As also used throughout the specification and the claims, "unidirectional wheels", or "in-line wheels" are substantially short cylindrical or disk-shaped wheels mounted from a laterally extending horizontal wheel axle. Unidirectional wheels can roll only forward, and in the opposite direction backward, and can be optionally restrained from rolling backward to provide better pushing and braking action against backward motion.

Any reference in the specification and the claims to "the body of a skater", means any part of the skater's body, including anything worn on the body of the skater, except the foot of the skater. In the case of a towed animal, the term includes the paw of the animal.

The term "in-line" as used throughout the specification and the claims with reference to a skate means that wheel or wheels of the skating accessory are adapted to contact the ground substantially along a straight line.

The present invention is an in-line skating accessory which has at least one omnidirectional wheel, or unidirectional wheel, mounted from means for attaching either kind of wheel to the body of a skater or in the case of a towed animal, to the foot of the animal.

A large variety of such attaching means is provided by the present invention for attaching a wheel or wheels to certain parts of the body, or to a garment worn by the skater, such as a suit having wheels at a variety of preselected strategic locations thereon.

BRIEF DESCRIPTION OF THE DRAWING

The present invention is further explained through the description of suitable embodiment thereof, with reference being had to the attached drawing, wherein.

DETAILED DESCRIPTION

Figure 1:
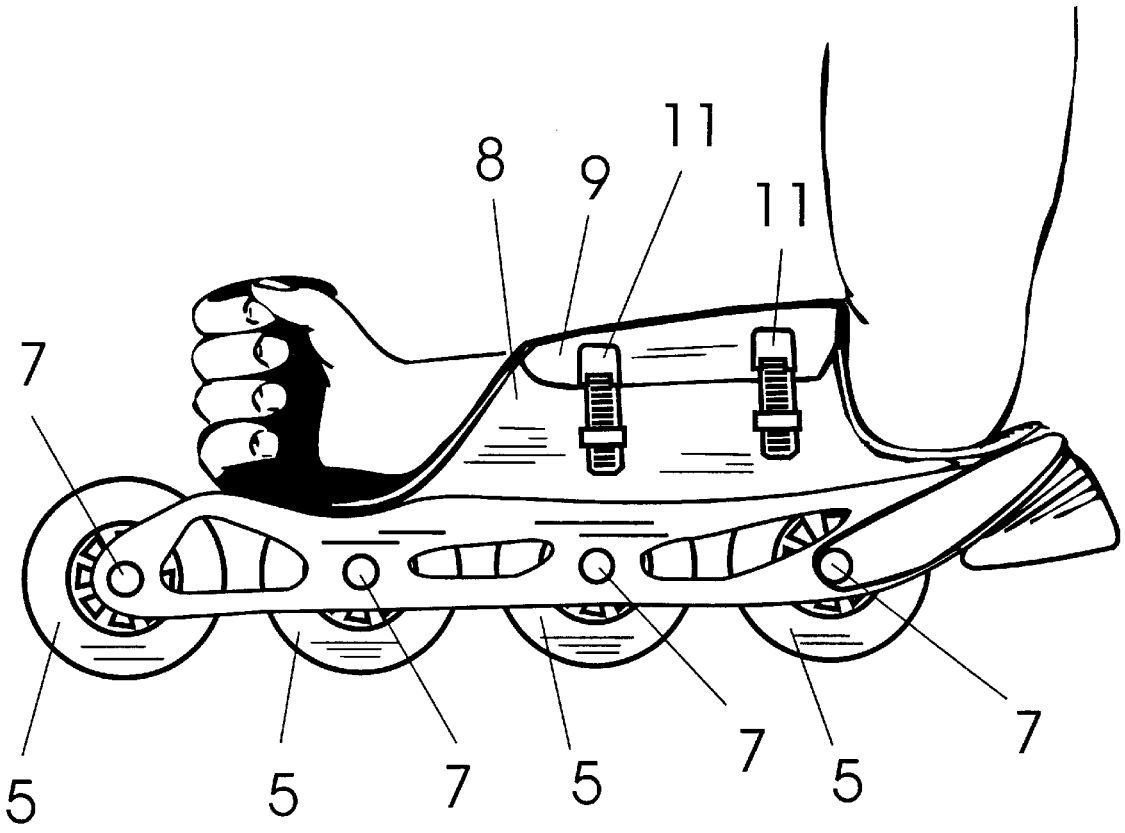
FIG. 1 is an in-line skating accessory for attaching in-line wheels to the lower arm of a skater.

FIG. 1 shows a lower arm in-line skating accessory 1 of the present invention. The accessory 1 has an in-line skating accessory body 3 for in-line wheels 5 mounted from horizontal axles 7 from the in-line skating accessory body 3 the upper surface of the in-line skating accessory body 3 is contoured or is provided with padding comfortably to accommodate the lower arm of a skater. The accessory 1 is attached to the lower arm of a skater by mounting flaps 9 secured with attaching straps 11. The lower arm in-line skating accessory 3 is shown with a rear brake pad 13, attached to the accessory. If desired, the rear brake pad 13 can be actuated by gripping an actuator by the fingers.

Figure 2:
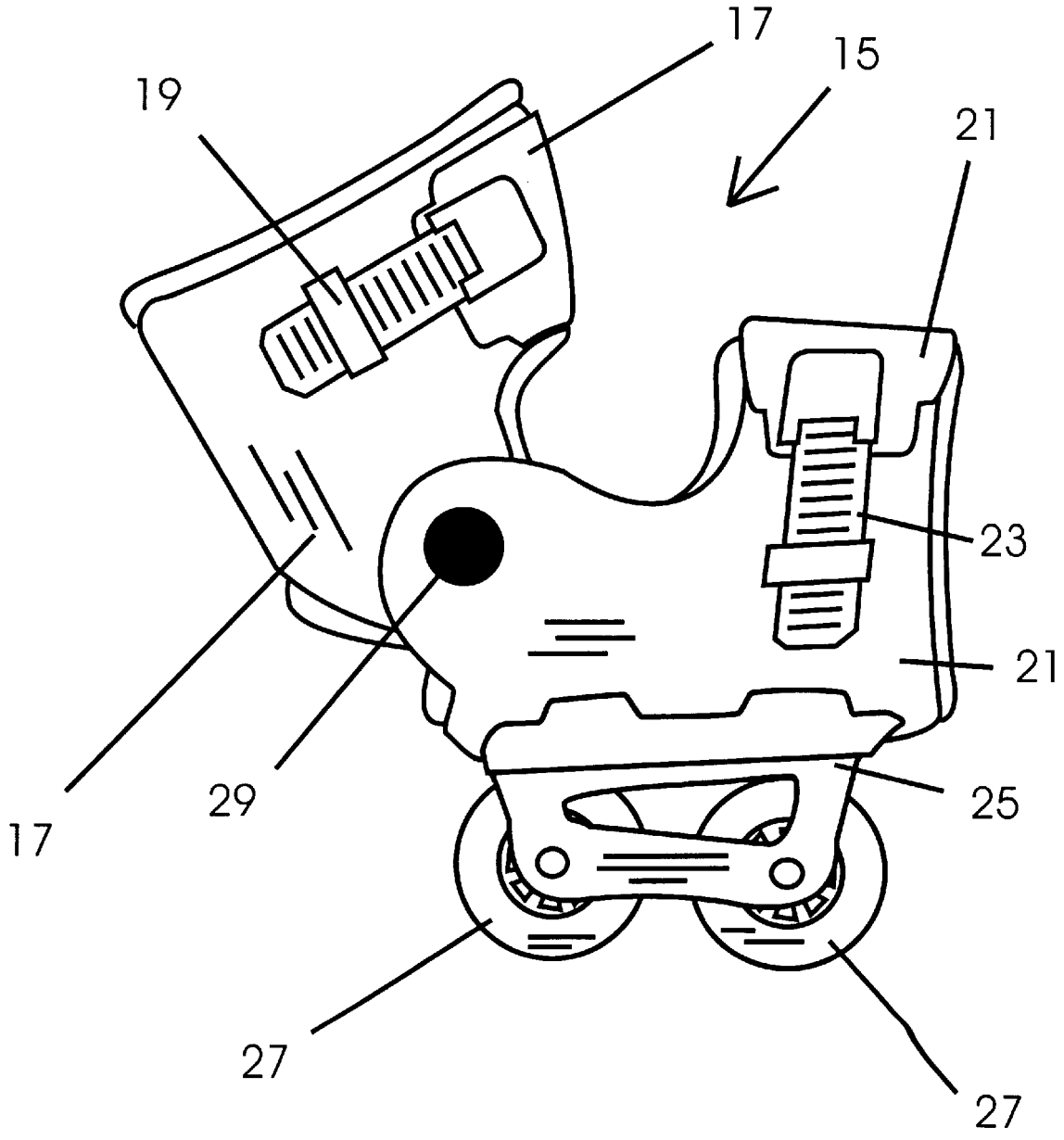
FIG. 2 is an in-line skating accessory for attaching in-line wheels to the knee of a skater.
Figure 3:
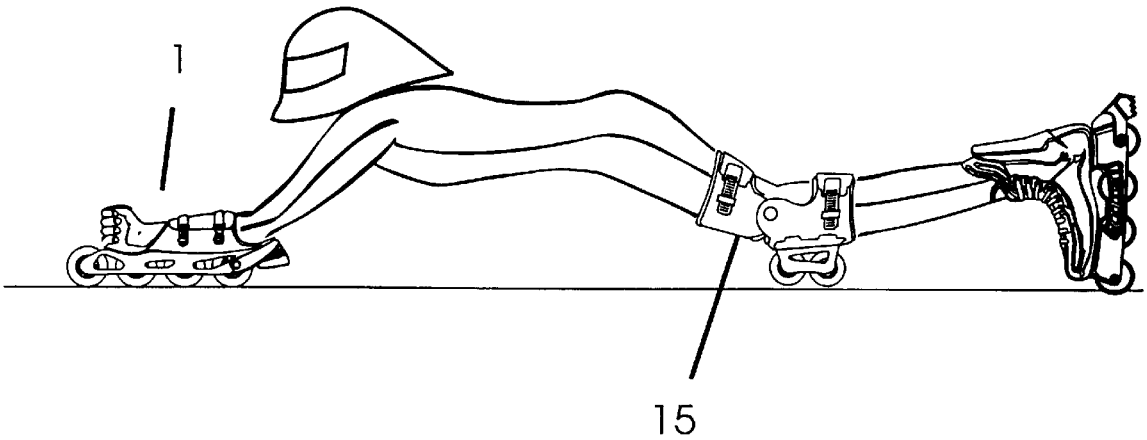
FIGS. 3–20 show skaters with in-line accessories of the present invention in various acrobatic attitudes that are enabled by the invention.
Figure 4:
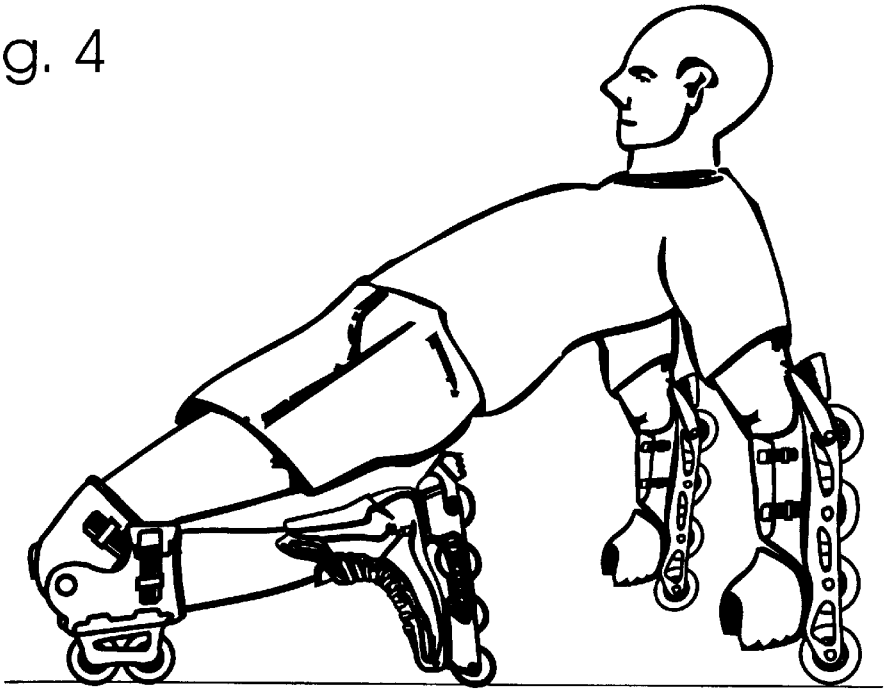
Figure 5:
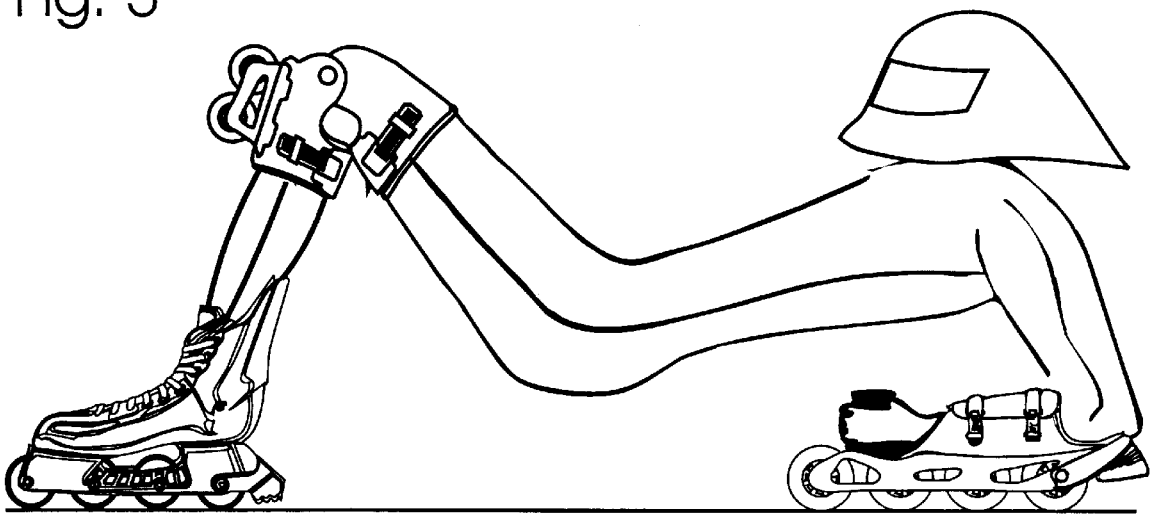
Figure 6:
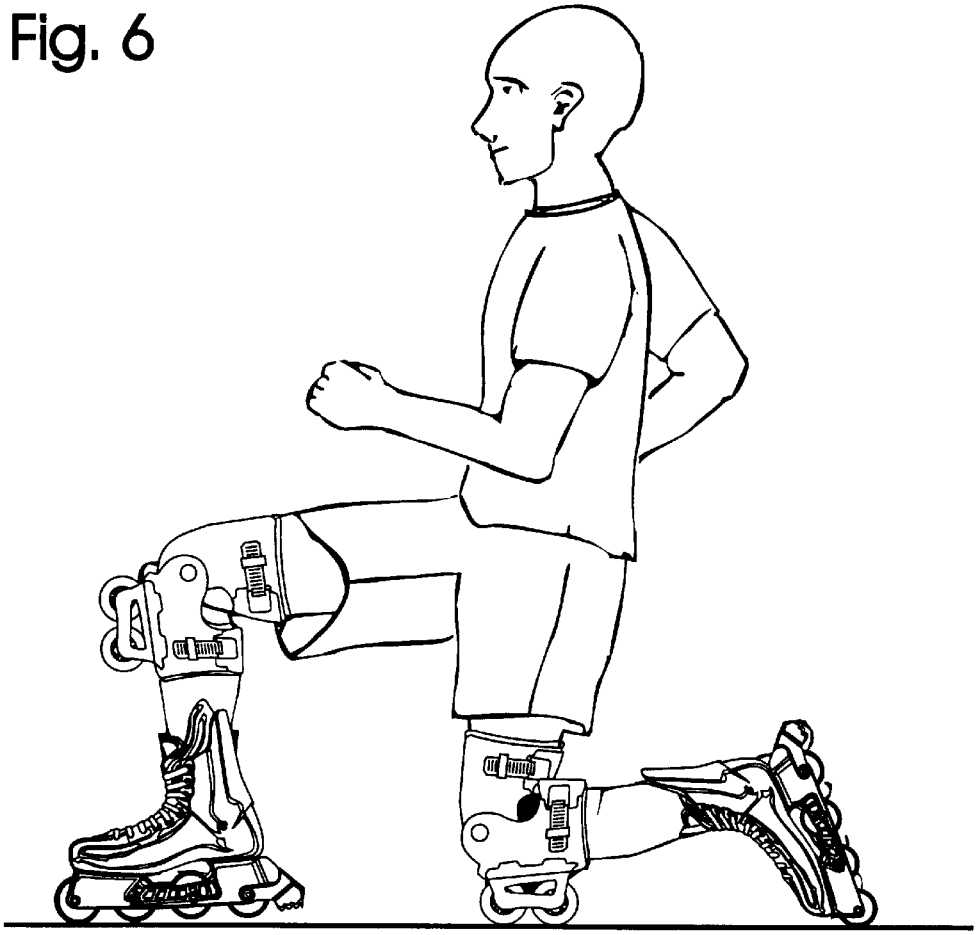
Figure 7:
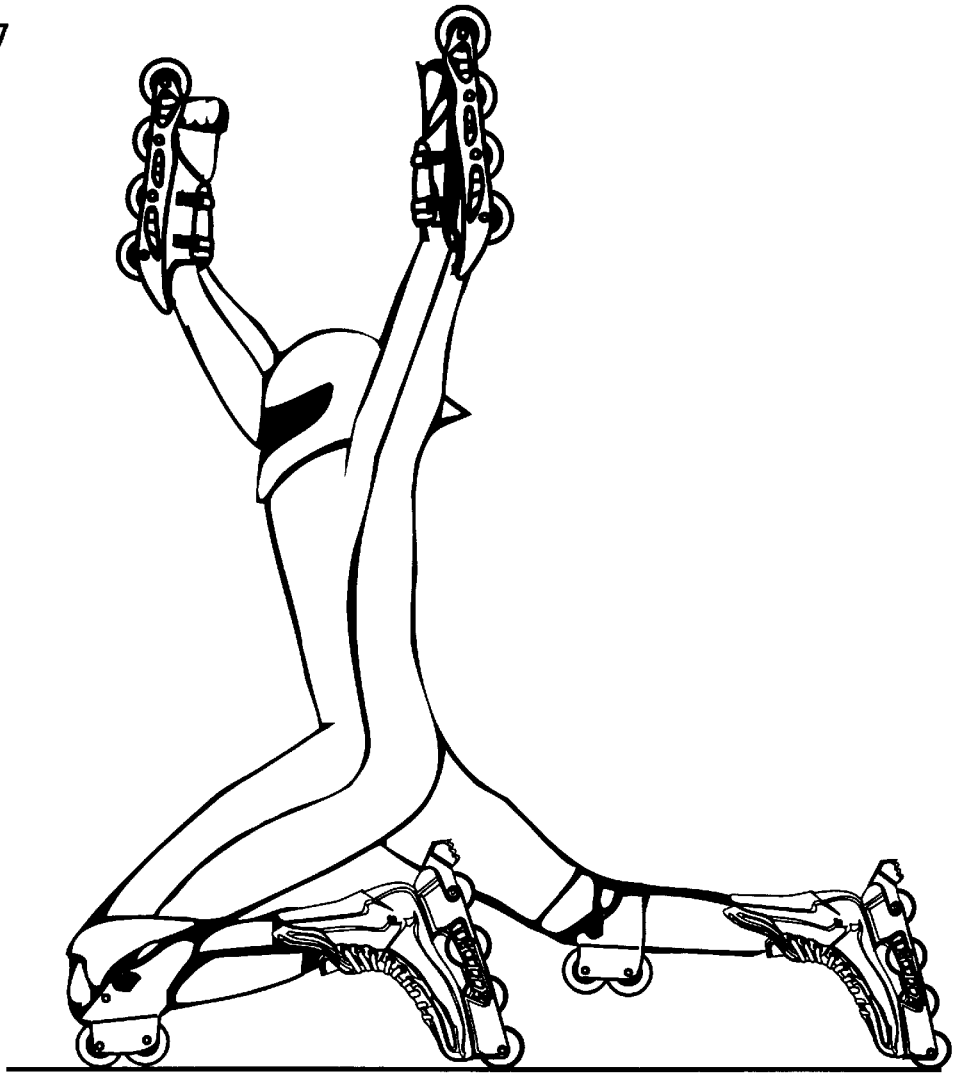
Figure 8:
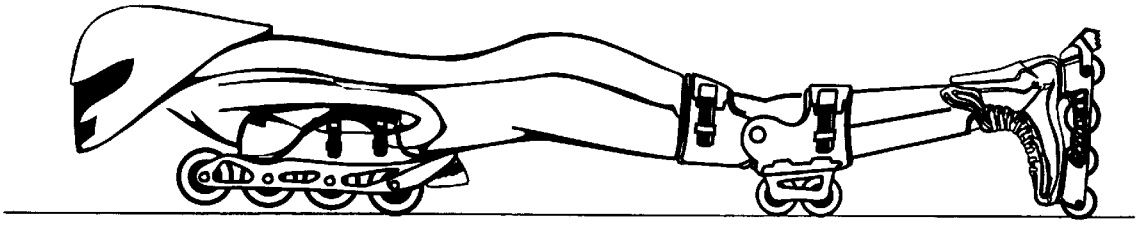
Figure 9:
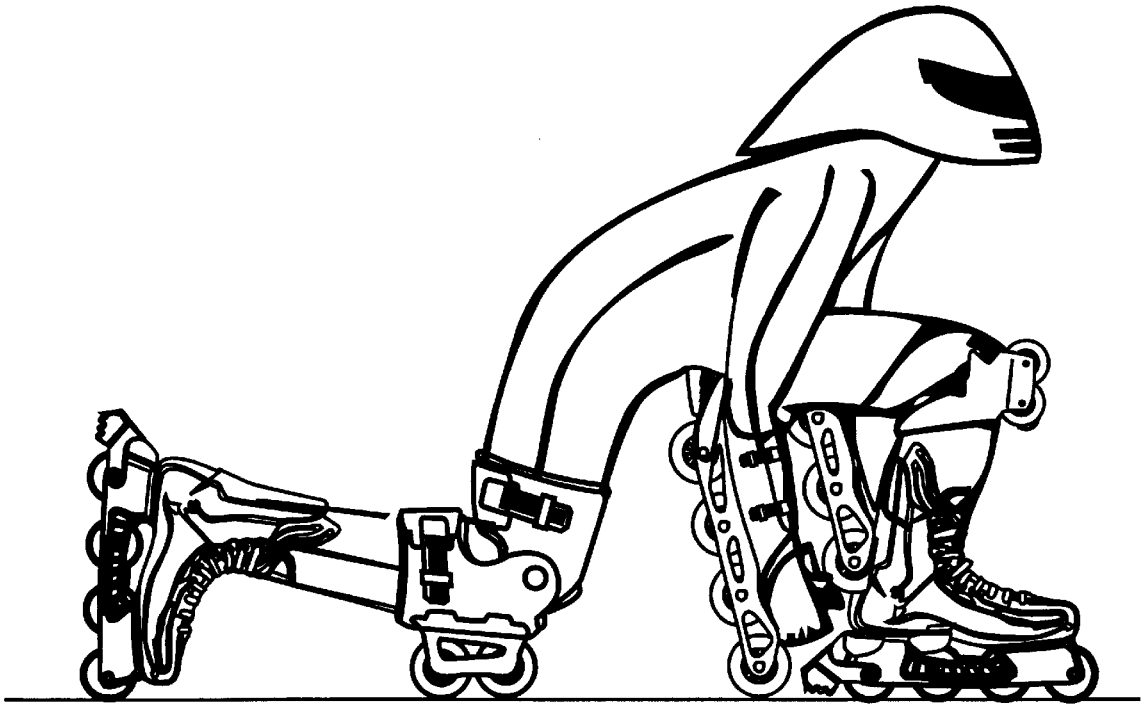
Figure 10:
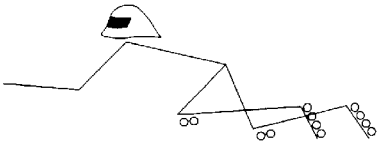
Figure 11:
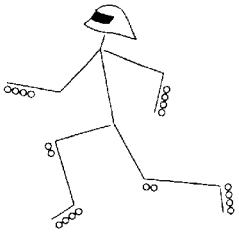
Figure 12:
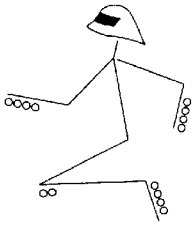
Figure 13:
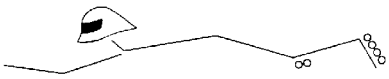
Figure 14:
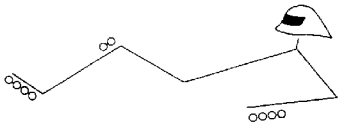
Figure 15:
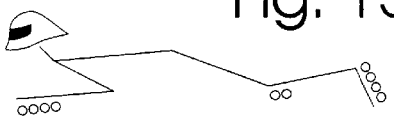
Figure 16:
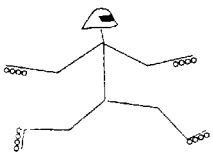
Figure 17:
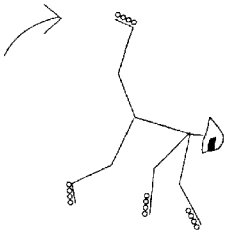
Figure 18:
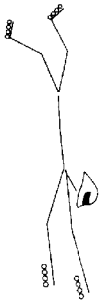
Figure 19:
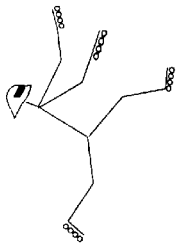
Figure 20:
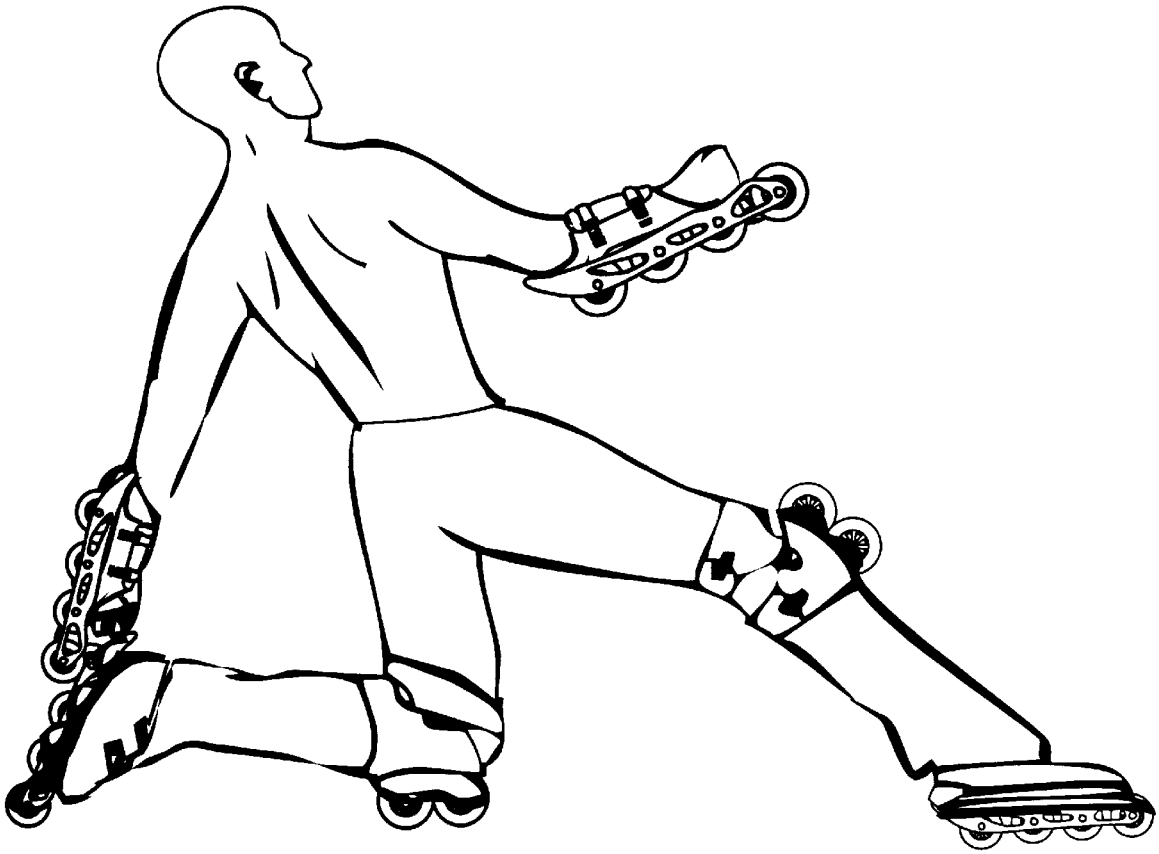

A knee in-line skating accessory 15 is shown in FIG. 2, adapted to be attached above the knee of the wearer by upper mounting flaps 17 secured with an upper attaching strap 19, and below the knee of the skater by lower mounting flaps 21 secured with a lower attaching strap 23. The lower mounting flaps 21 are attached to an in-line skating accessory body 25, and the above-knee and the below-knee parts of the leg of the wearer rest on an appropriately contoured or cushioned top surfaces of the in-line skating accessory body 25. A pair of in-line wheels 27 are mounted from the in-line skating accessory body 25. Optionally one or both wheels 27 may have means (not shown) providing only for unidirectional forward movement of the knee in-line skating accessory 15, enabling the knee in-line skating accessory 5 to be used as a means for preventing backward rolling.

The upper mounting flaps 17 of the knee in-line skating accessory 15 are suitably hinged at 29 from the lower mounting flaps 21 enabling the bending of the user's knee at any angle when the knee in-line skating accessory 15 is attached thereto.

FIGS. 3–20 show various ways an attitudes in which lower arm in-line skating accessories 1, and knee in-line skating accessories 15 can be used in conjunction with in-line skates. As can be readily seen in these figures, these various accessories enable a practically infinite number of acrobatic and extreme in-line skating positions and attitudes.

Figure 21:
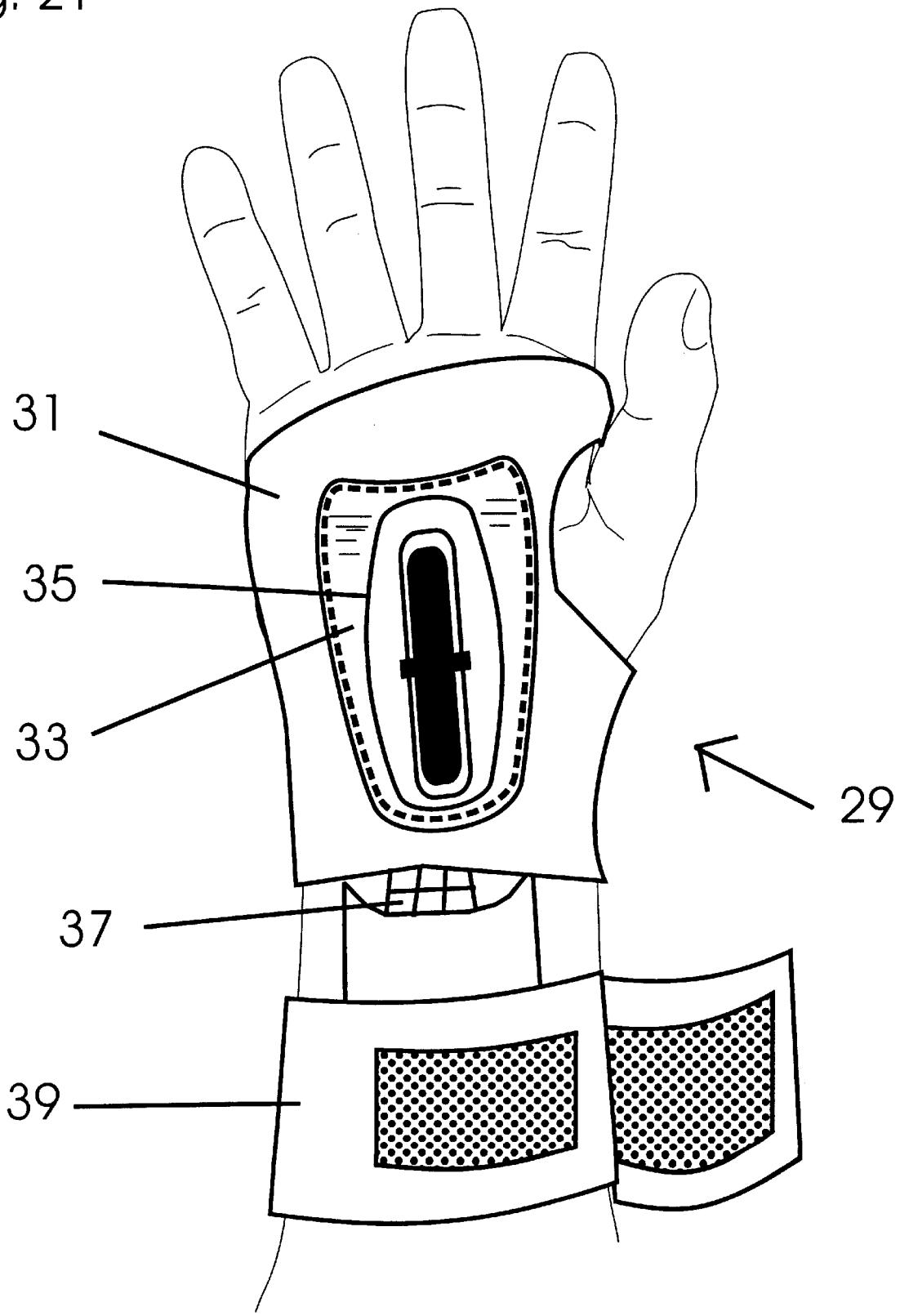
FIG. 21 shows a palm wheel attachment accessory with a palm accessory brake.

A palm in-line roller accessory 29 is shown in FIG. 21, having a palm attaching body 31 with a palm portion reinforcement 33. An in-line roller wheel 35 is mounted from the palm portion reinforcement 33. A brake pad 37 is provided at the inner end of the palm portion reinforcement 33 and can optionally be attached to the palm attaching body 31. Suitably a wrist band 39 is used to attach and reinforce the palm-attaching body 31. The palm in-line roller accessory can be used for example for hands-down in-line skating and tricks for rolling hand stands, or for rolling head stands such as when a helmet with upside down wheels (FIG. 25) is worn by the skater.

Figure 22:
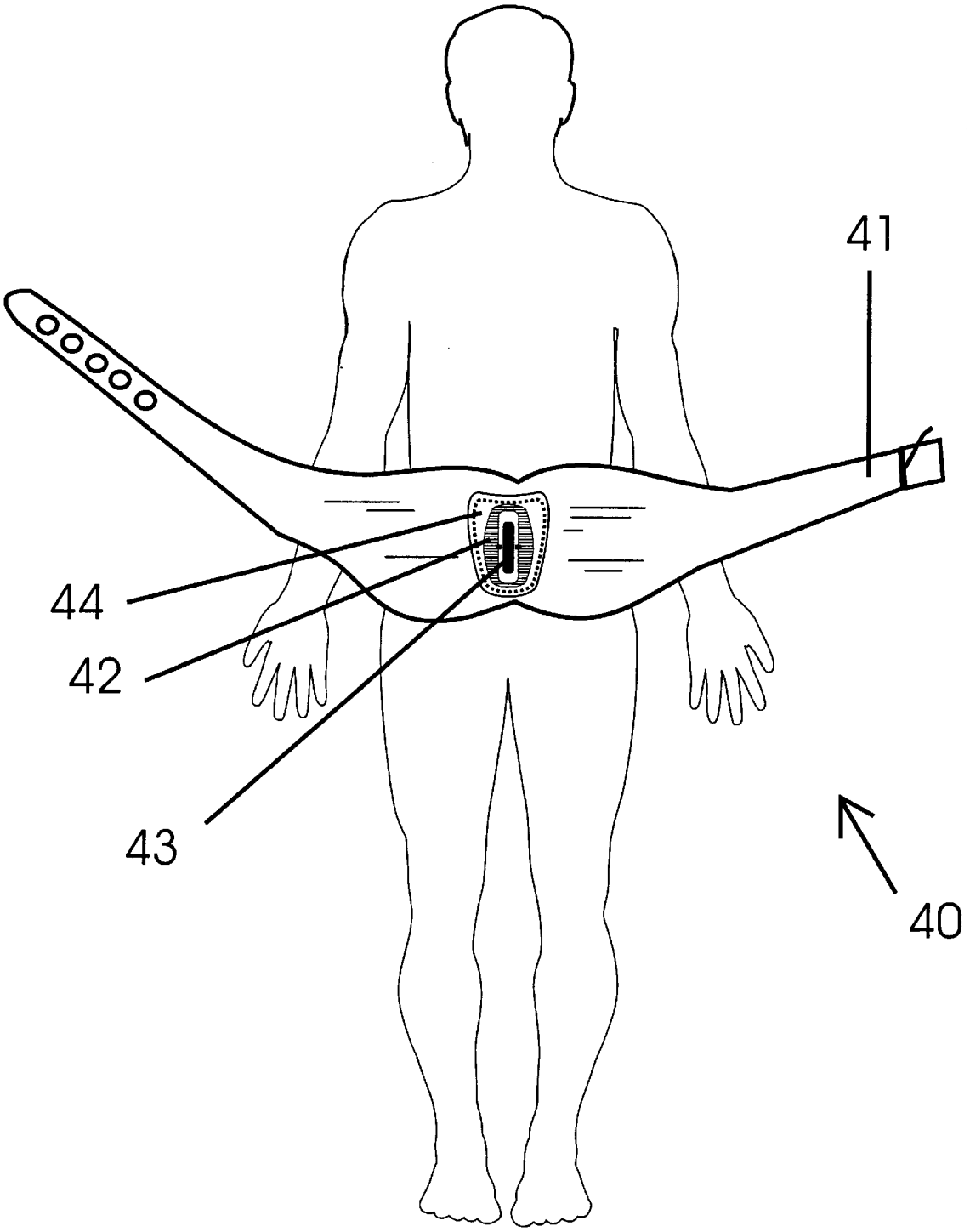
FIG. 22 shows an abdominal belt accessory with an omnidirectional wheel thereon.
Figure 23:
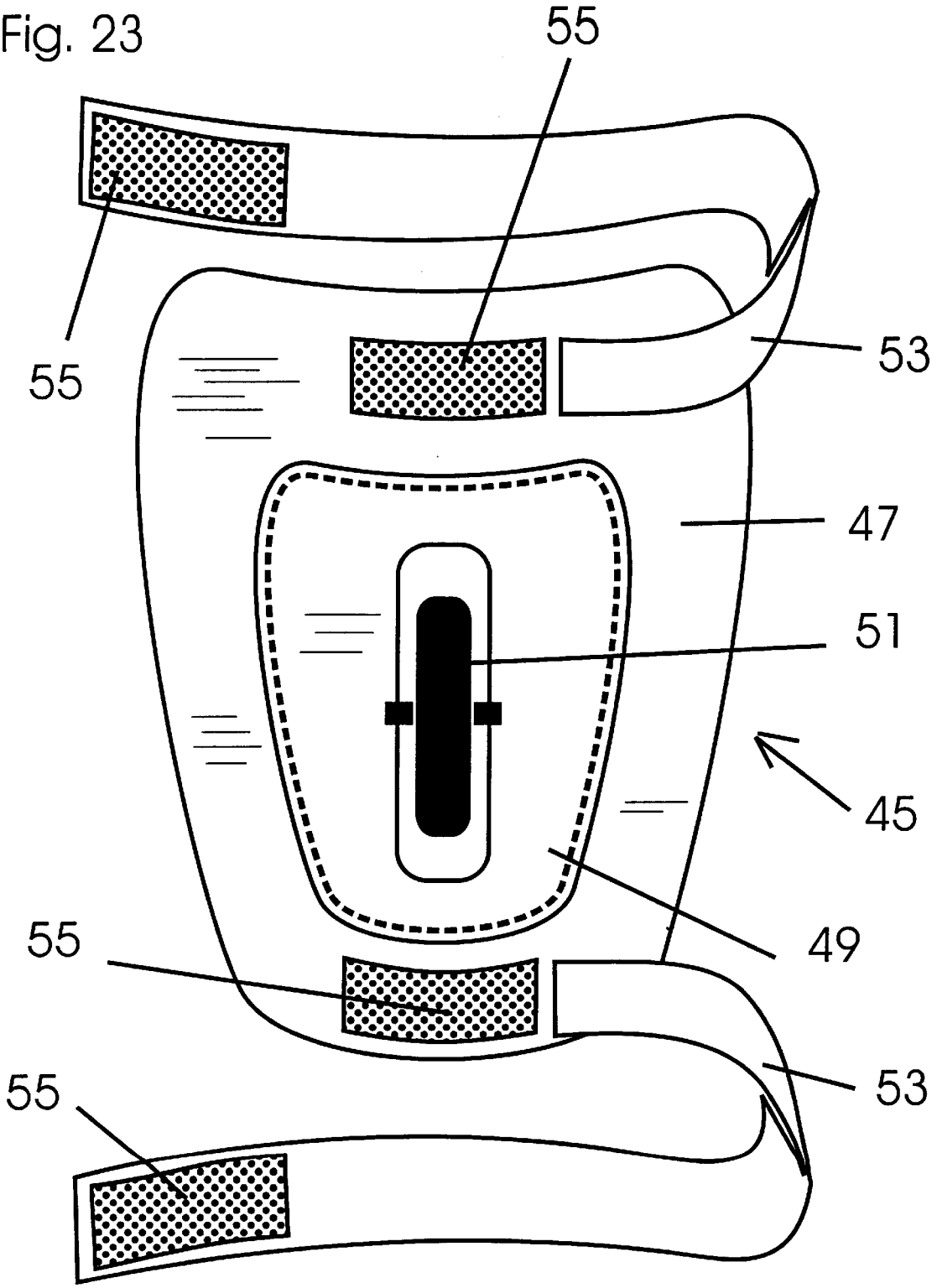
FIG. 23 shows a knee attachment accessory with a single in-line wheel.

An abdominal wheel attachment in-line skating accessory 40 is shown in FIG. 22. A belt 41 has a socket 42 mounted thereon and rotatably containing an omnidirectional spherical wheel 43. A body attachment 44 is employed for attaching the socket 42 to the belt 41. The abdominal wheel attachment in-line skating accessory 40 enables a skater to carry out an in-line skating belly rolling, suitably in an outwardly arched body position, or otherwise when supported by one or more other wheel attachment accessories attached to other parts of the body of the skater. Although an "abdominal" wheel attachment in-line skating accessory 40 is described hereinabove, it should be understood that the reference to "abdominal" throughout the specification and the claims intends to encompass attachment in the same manner to any other part of the body for which a belt-like attachment is suitable.

Figure 24:
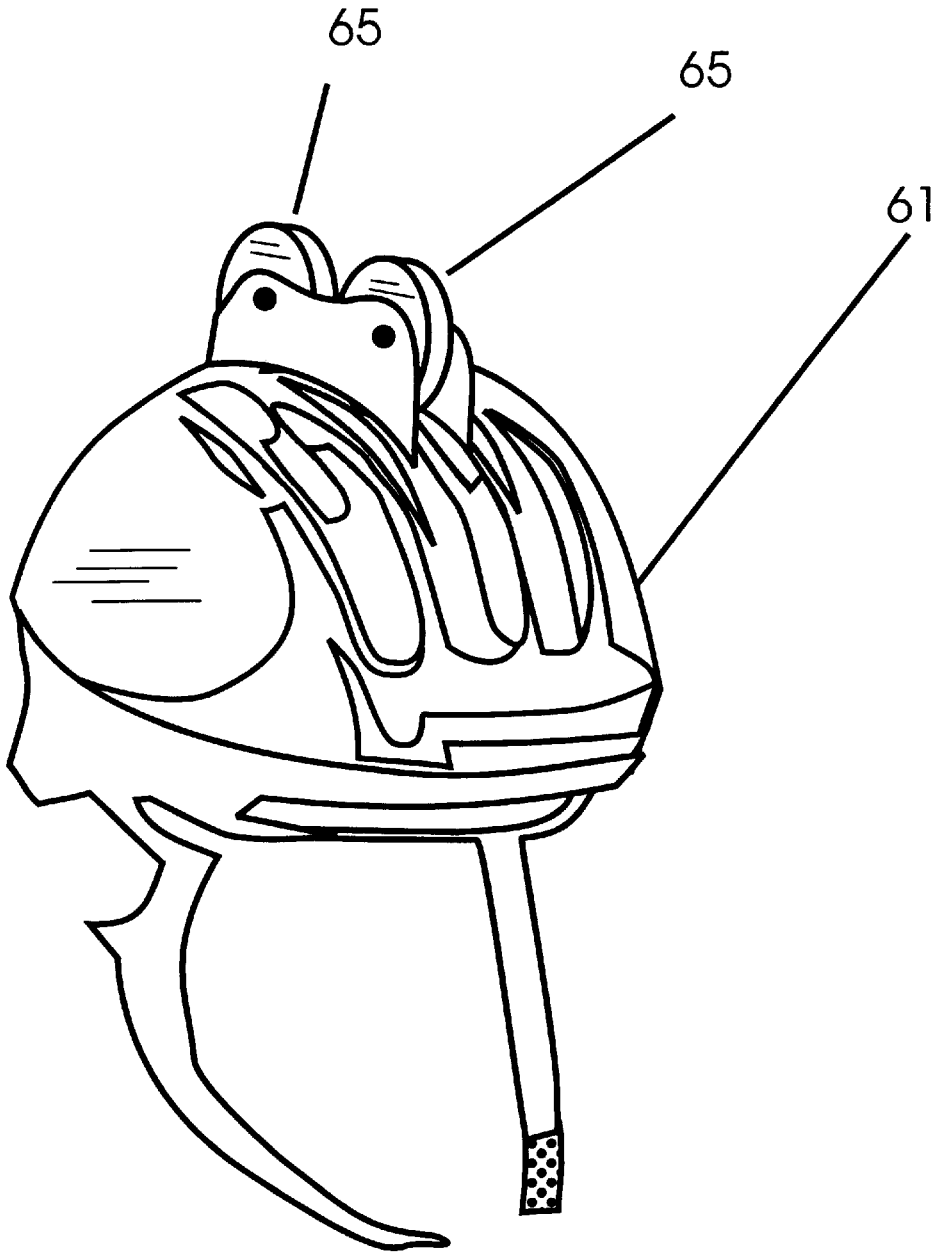
FIG. 24 is an in-line skating helmet with two in-line wheels attached to the top of the helmet.

A wheeled suit accessory 57 is shown in FIG. 24, having a plurality of wheels 59 attached to various predetermined parts thereof. The wearing of the wheeled suit accessory 57 enables either relaxed rolling, or most acrobatic variety of roller skating positions by the skater, in which normally only a single wheel, or more wheels that are in-line on the suit accessory 57.

An accessorized skating helmet 61 is shown in FIG. 25, provided with two in-line wheels 65 at the top of the helmet that are adapted to roll on the ground when the head of the skater is upside down as shown in FIG. 25.

A skating chair accessory 67 is shown in FIG. 26 with a seat portion 69 and optional head supports 71. A wheel 73 is mounted from the lower end of the skating chair accessory 67 enabling a further variation in the positions assumed by a skater.

A flipping or braking accessory 75 is shown in FIG. 27 having a handle 79 at its upper end, and a suitably bifurcated lower end 81 with pads 83 mounted from the lower ends 81 either for breaking the skater's motion suitably by extending the braking accessory 75 rearwardly between the legs of the skater and bearing down with the pads 83 on to the skated-on surface, or by extending the flipping accessory 75 forward to assist in a flip or other acrobatic movement.

An animal in-line skating accessory 85 is shown in FIG. 28 with wheels 87 being strapped with an attaching means 89 to each leg of the animal. Suitably the wheels 87 are in-line wheels, and most suitably they contain breaking means (not shown) to permit only forward unidirectional skating by the suitably towed animal.

An in-line roller skate 91 is shown in FIG. 29 having a plurality of in-line wheels 93 with a spherical roller wheel 95 mounted within a casing 97 for unidirectional as well as omnidirectional skating of the in-line skate body 99.

There are a wide variety of choices available in accordance with the present invention, whether to use omnidirectional wheels, unidirectional wheels (optionally restricted from backward rolling), or a mix of omnidirectional and unidirectional wheels for a particular in-line skate or in-line accessory. The present invention, however, does not include in-line skates having unidirectional wheels only, since that defines the known in-line skates. The considerations that govern the selection among the above choices will depend on the skater's personal preferences and the degree of difficulty desired.

As can be readily understood from the foregoing detailed description, the in-line skates and accessories of the present invention open up a completely new dimension of in-line skating as well as enable heretofore unimagined variety of acrobatic positions and extreme movements in in-line skating.

I claim:

1. A wheeled skating accessory for use by a skater having a body, said body having feet with in-line skates attached to said feet, a head, a palm, an arm, a knee, and an abdomen, the accessory comprising means for attaching a wheel to the body of the skater, and at least one wheel combined with said means for attaching.

2. The skating accessory of claim 1, wherein a plurality of wheels is mounted from said means for attaching, and wherein at least one of said plurality is an omnidirectional or a unidirectional wheel.

3. The skating accessory of claim 2, wherein all of said plurality are omnidirectional wheels.

4. The skating accessory of claim 2, wherein all of said plurality are unidirectional wheels.

5. The skating accessory of claim 1, wherein said means for attaching comprises a belt, flaps secured to a skate body and attachable to the body of a skater other than the foot of the skater by velcro closures or by one or more straps optionally provided with buckles.

6. The skating accessory of claim 5, further comprising padding disposed between said means for attaching and an adjacent body part of the skater for reducing any discomfort to the skater resulting from the attachment of the accessory.

7. A skating accessory for use by a skater having a body, said body having feet with in-line skates attached to said feet, the accessory comprising at least one wheel, and means for attaching said wheel to the body of a skater other than his foot, said wheel being mounted from said means for attaching.

8. The skating accessory of claim 7 wherein the accessory is attached to the knee of the skater.

9. The skating accessory of claim 8, wherein said wheel is a unidirectional wheel.

10. The skating accessory of claim 9, containing a plurality of wheels, wherein said plurality is a plurality of in-line wheels mounted from said means for attaching.

11. Skating accessory means for rolling on a surface and for attachment to the body of a skater other than the feet of the skater, when an in-line skate is attached to the foot of the skater, the skating accessory means comprising at least one wheel means for maintaining spaced from said surface a part of the body of the skater that is proximate to said wheel means, and means for attaching said wheel means to said part of the body of the skater.

12. The wheeled skating accessory of claim 1 wherein said means for attaching comprises a helmet for mounting at least one wheel to the top of the head of the skater.

13. The wheeled skating accessory of claim 1, wherein said means for attaching comprises means for attaching at least one wheel to the palm of the skater.

14. The wheeled skating accessory of claim 1, wherein said means for attaching comprises means for attaching at least one wheel to the lower arm of the skater.

15. The wheeled skating accessory of claim 1, wherein said means for attaching comprises means for attaching at least one wheel to the knee of the skater.

16. The wheeled skating accessory of claim 1, wherein said means for attaching comprises means for attaching at least one wheel to the abdomen of the skater.

17. The wheeled skating accessory of claim 1, wherein said means for attaching comprises a suit for attaching wheels to the body of the skater other than its foot.

18. A wheeled skating accessory for use by a skater having a body, said body having feet with in-line skates attached to said feet, a head, a palm, an arm, a knee, and an abdomen, the accessory comprising means for attaching a wheel to the body of the skater, and a plurality of unidirectional wheels mounted from said means for attaching.

19. A wheeled skating accessory for use by a skater having a body, said body having feet with in-line skates attached to said feet, a head, a palm, an arm, a knee, and an abdomen, the accessory comprising means for attaching a wheel to the body of the skater, and at least one wheel combined with said means for attaching, and an in-line skate attached to each of said feet.

20. The skating accessory of claim 19, wherein a plurality of wheels is mounted from said means for attaching, and wherein at least one of said plurality is an omnidirectional or a unidirectional wheel.

21. The skating accessory of claim 20, wherein all of said plurality are omnidirectional wheels.

22. The skating accessory of claim 20, wherein all of said plurality are unidirectional wheels.

23. The skating accessory of claim 19, wherein said means for attaching comprises a belt, flaps secured to a skate body and attachable to the body of a skater other than the foot of the skater by velcro closures or by one or more straps optionally provided with buckles.

24. The skating accessory of claim 23, further comprising padding disposed between said means for attaching and an adjacent body part of the skater for reducing any discomfort to the skater resulting from the attachment of the accessory.

25. Skating accessory means for rolling on a surface and for attachment to the body of a skater other than the feet of the skater, the skating accessory means comprising at least one wheel means for maintaining spaced from said surface a part of the body of the skater that is proximate to said wheel means, means for attaching said wheel means to said part of the body of the skater, and an in-line skate attached to each foot of the skater.

26. The wheeled skating accessory of claim 19, wherein said means for attaching comprises a helmet for mounting at least one wheel to the top of the head of the skater.

27. The wheeled skating accessory of claim 19, wherein said means for attaching comprises means for attaching at least one wheel to the palm of the skater.

28. The wheeled skating accessory of claim 19, wherein said means for attaching comprises means for attaching at least one wheel to the lower arm of the skater.

29. The wheeled skating accessory of claim 19, wherein said means for attaching comprises means for attaching at least one wheel to the knee of the skater.

30. The wheeled skating accessory of claim 19, wherein said means for attaching comprises means for attaching at least one wheel to the abdomen of the skater.

31. The wheeled skating accessory of claim 19, wherein said means for attaching comprises a suit for attaching wheels to the body of the skater other than its foot.

* * * * *